US010191438B2

(12) United States Patent
Takase

(10) Patent No.: US 10,191,438 B2
(45) Date of Patent: Jan. 29, 2019

(54) IMAGE FORMING APPARATUS

(71) Applicant: CANON KABUSHIKI KAISHA, Tokyo (JP)

(72) Inventor: Kazuki Takase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 15/404,319

(22) Filed: Jan. 12, 2017

(65) Prior Publication Data

US 2017/0205757 A1 Jul. 20, 2017

(30) Foreign Application Priority Data

Jan. 14, 2016 (JP) ..... 2016-005051

(51) Int. Cl.
*G03G 15/00* (2006.01)
*G03G 21/00* (2006.01)

(52) U.S. Cl.
CPC ..... *G03G 21/0005* (2013.01); *G03G 15/5054* (2013.01); *G03G 21/00* (2013.01); *G03G 2215/0132* (2013.01)

(58) Field of Classification Search
CPC ..... G03G 15/0131; G03G 15/5058; G03G 15/1615
See application file for complete search history.

(56) References Cited

U.S. PATENT DOCUMENTS

2013/0322910 A1* 12/2013 Shiga ..... G03G 15/5054 399/74
2014/0212152 A1* 7/2014 Suzuki ..... G03G 21/1633 399/16
2016/0154369 A1 6/2016 Takase et al.

FOREIGN PATENT DOCUMENTS

| | | | |
|---|---|---|---|
| JP | H04-155358 | A | 5/1992 |
| JP | 2655603 | B2 | 9/1997 |
| JP | 2004-333959 | A | 11/2004 |
| JP | 2007-225955 | A | 9/2007 |
| JP | 2010-026157 | A | 2/2010 |

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes an image bearing member, an optical sensor including a light emitting portion, a light receiving portion and a cover member, a cleaning member, and a supporting member movable between a proximity position where the optical sensor opposes the image bearing member with a predetermined distance and a spaced position where the optical sensor is spaced from the image bearing member by a distance more than the predetermined distance to form a cleaning space between the optical sensor and the image bearing member. When the supporting member is in the proximity position, the cleaning member is in a retracted position retracted from an opposing space between the optical sensor and the image bearing member. When the supporting member is in the spaced position, the cleaning member is in a cleaning position for cleaning the cover member with the cleaning member.

13 Claims, 7 Drawing Sheets

(a)

(b)

(a)

(b)

IMAGE FORMING APPARATUS

FIELD OF THE INVENTION AND RELATED ART

The present invention relates to an image forming apparatus of an electrophotographic type or an electrostatic recording type.

In the image forming apparatus, it is important that respective color toner images are transferred superposedly onto a belt or a recording material at an accurate position, and therefore color registration control such as correction of a writing start position of the image on a photosensitive drum is carried out. For example, in a position adjusting unit disclosed in Japanese patent No. 2655603, toner marks, which are called registration marks, register marks or the like, with respective color toners (hereinafter referred to as a registration marks) are formed as reference images for detecting color registration on an intermediary transfer member. Then, the registration marks are detected by an optical sensor provided downstream of a black image forming portion for a final color on the intermediary transfer member, and the writing start position of the image on the photosensitive drum is corrected.

The optical sensor is constituted by combining an LED as a light emitting portion for emitting light with a phototransistor as a light receiving portion for receiving reflected light from the intermediary transfer member. The registration marks are formed in two lines in general along a belt movement direction at widthwise end portions of the intermediary transfer member. Accordingly, the optical sensor is provided at two positions at the widthwise end portions of the intermediary transfer member and is fixed to a stay, whereby the optical sensor is held below the belt with a predetermined gap from the belt. The optical sensor is covered with a transparent cover glass at an upper surface thereof. However, in the registration mark detection by the optical sensor, the toner images are formed on the intermediary transfer member in a normal image forming range, and therefore the toners scatter from the toner images although an amount thereof is slight, so that the toners are deposited on the cover glass of the optical sensor. Such toner deposition causes a fluctuation (lowering) in output of the optical sensor in some cases.

As a solution of the problem, it has been tried to set formation positions and detection positions of the registration marks on the intermediary transfer member at outsides of a normal image formation width. However, the setting of the formation positions and detection positions of the registration marks on the intermediary transfer member at the outsides of the image formation width requires extension of a belt width and leads to increases in size and cost of an apparatus main assembly.

Further, the above-described problems similarly exist also in a device constitution in which reference images (density patches) for density control are formed on the intermediary transfer member and a density thereof is detected and then an image density is controlled by supply control of toner to a developing device or the like control. In addition, the problems similarly generates also in a device constitution in which the reference images are directly formed on a feeding belt as a recording material carrying member and then color registration control or density control is carried out.

SUMMARY OF THE INVENTION

A principal object of the present invention is to provide an image forming apparatus capable of maintaining detection accuracy of an optical sensor while avoiding upsizing of the image forming apparatus.

According to an aspect of the present invention, there is provided an image forming apparatus comprising: an image bearing member for bearing a developer image; an optical sensor including a light emitting portion for emitting light to a surface of the image bearing member, a light receiving portion for receiving the light reflected by the surface of the image bearing member, and a cover member, having a light-transmissive property, for covering the light emitting portion or the light receiving portion; a cleaning member for cleaning the cover member in contact with the cover member; and a supporting member for supporting the optical sensor, the supporting member being movable between a proximity position where the optical sensor opposes the image bearing member with a predetermined distance and a spaced position where the optical sensor is spaced from the image bearing member by a distance more than the predetermined distance to form a cleaning space for permitting cleaning of the cover member with the cleaning member between the optical sensor and the image bearing member, wherein when the supporting member is in the proximity position, the cleaning member is in a retracted position retracted from an opposing space between the optical sensor an the image bearing member, and when the supporting member is in the spaced position, the cleaning member is in a cleaning position for cleaning the cover member with the cleaning member.

Further features of the present invention will become apparent from the following description of exemplary embodiments with reference to the attached drawings.

DESCRIPTION OF THE EMBODIMENTS

Embodiments of the present invention will be specifically described with reference to the drawings. Dimensions, materials, shapes and relative arrangements of constituent elements described in the following embodiments should be appropriately be changed depending on structures and various conditions of devices (apparatuses) to which the present invention is applied. That is, the scope of the present invention is not intended to be limited to the following embodiments.

Embodiment 1

<General Structure and Operation of Image Forming Apparatus>

Figure 1:
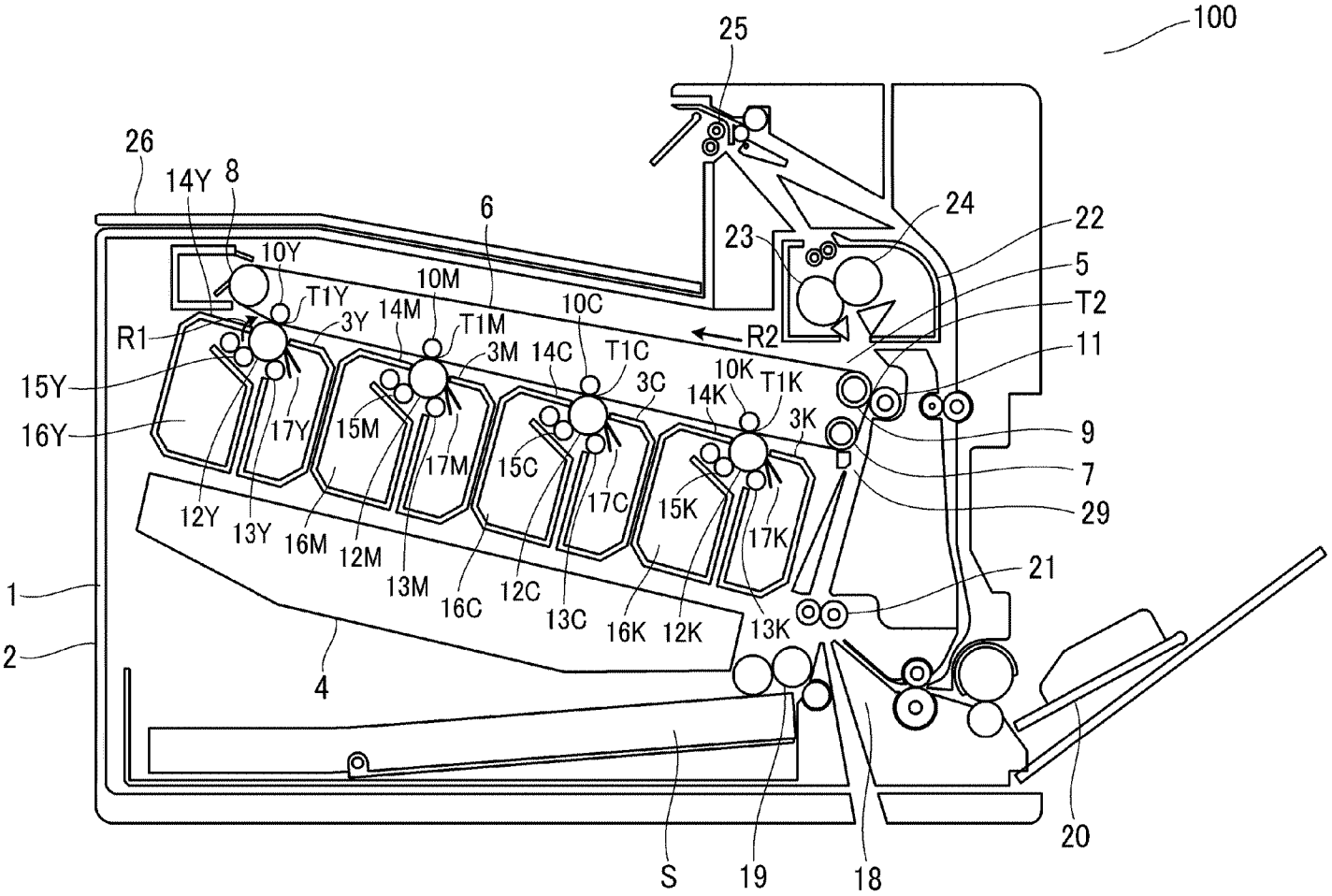
FIG. 1 is a schematic view of the image forming apparatus according to an embodiment of the present invention.

FIG. 1 is a schematic sectional view of an image forming apparatus 100 according to Embodiment 1 of the present invention. In this embodiment, as one of image forming apparatuses to which the present invention is applicable, a color laser beam printer of a tandem type (4-drum type) employing an intermediary transfer process in which a full-color image can be formed using an electrophotographic process will be described.

The image forming apparatus 100 includes first to fourth process cartridges 3Y, 3M, 3C, 3K which are arranged in line as a plurality of image forming portions. These process cartridges 3Y, 3M, 3C, 3K form toner images (developer images) of yellow (Y), magenta (M), cyan (C), black (K), respectively. Below these process cartridges 3Y, 3M, 3C, 3K, a laser scanner 4 as an exposure unit is provided. Above the process cartridges 3Y, 3M, 3C, 3K, an intermediary transfer unit 5 for transferring the toner images from the process cartridges 3Y, 3M, 3C, 3K onto a transfer-receiving material (recording material). Incidentally, constituent elements which are provided for forming the respective color images and which have substantially the same structures and functions will be collectively described by omitting suffixes Y, M, C, K of reference numerals or symbols for representing the elements for the associated colors in the case where there is no need to particularly distinguish the elements.

The process cartridge 3 includes a photosensitive drum 12 which is an electrophotographic photosensitive member of a rotatable drum (cylinder) type. The process cartridge 3 further includes, as process members actable on the photosensitive drum 12, a charging roller 13 which is a roller-type charging member, a developing unit (developing device) 14, and a drum cleaning unit 17 as a cleaning unit means for the photosensitive member. These members consisting of the photosensitive drum 12, the charging roller 13, the developing device 14, and the drum cleaning unit 17 are integrally detachably mountable to an apparatus main assembly 1 of the image forming apparatus 100.

The photosensitive drum 12 is rotationally driven in an arrow R1 direction in FIG. 1 at a predetermined speed (peripheral speed) by an unshown driving source and an unshown driving train. A surface of the rotating photosensitive drum 12 is electrically charged uniformly to a predetermined polarity (negative in this embodiment) and a predetermined charging potential by the charging roller 13. At this time, to the charging roller 13, a predetermined charging voltage (charging bias) is applied. The surface of the charged photosensitive drum 12 is subjected to scanning exposure with a laser beam emitted from the laser scanner 4 in accordance with image information of an associated color component. As a result, an electrostatic (latent) image in accordance with the image information of the associated color component is formed on the photosensitive drum 12. The electrostatic image formed on the photosensitive drum 12 is developed (visualized) as a toner image by using toner as a developer. The toner is accommodated in a developer container 16 of the developing device 14. At this time, to a developing roller 15 of the developing device 14, a predetermined developing voltage (developing bias) is applied. In this embodiment, the toner image is formed by image portion exposure and reverse development. That is, the developing device 14 deposits the toner charged to the same charge polarity (negative in this embodiment) of the photosensitive drum 12 on an exposure portion of the photosensitive drum 12 where an absolute value of the potential of the photosensitive drum 12 is lowered by exposure after the uniform charging.

The intermediary transfer unit 5 includes an intermediary transfer member 6, constituted as an intermediary transfer member by an endless belt, which is disposed to oppose the four photosensitive drums 12Y, 12M, 12C, 12K. The intermediary transfer member 6 is an example of a movable member used in the image forming apparatus 100 and one of constituent elements corresponding to image bearing (carrying) members for carrying the developer image together with the photosensitive drum 12 in the present invention. The intermediary transfer member 6 is stretched by, as a plurality of stretching rollers, a driving roller 7, a tension roller 8 and a secondary transfer opposite roller 9. The intermediary transfer member 6 is stretched by the plurality of stretching rollers in a state in which a predetermined tension is applied by the tension roller 8. The intermediary transfer member 6 is rotated (circulated and moved) in an arrow R2 direction in FIG. 1 by transmission of a driving force by rotational drive of the driving roller 7 by an unshown driving source and a unshown driving train. In a back side (inner peripheral surface side) of the intermediary transfer member 6, primary transfer rollers 10Y, 10M, 10C, 10K which are roller-shaped primary transfer members are provided at positions opposing the respective photosensitive drums 12Y, 12M, 12C, 12K. The primary transfer roller 10 is urged toward the photosensitive drum 12 through the intermediary transfer member 6, so that a primary transfer portion (primary transfer nip) T1 where the intermediary transfer member 6 and the photosensitive drum 12 are in contact with each other is formed. In the front surface side (outer peripheral surface side) of the intermediary transfer member 12, at a position opposing the secondary transfer opposite roller 9, a secondary transfer roller 11 which is a roller-shaped secondary transfer member is provided. The secondary transfer roller 11 is urged toward the secondary transfer opposite roller 9 through the intermediary transfer member 6, and forms a secondary transfer portion (secondary transfer nip) T2 where the intermediary transfer member 6 and the secondary transfer roller 11 are in contact with each other.

The toner images formed on the photosensitive drums 12 are transferred (primary-transferred) onto the intermediary transfer member 6 at the respective primary transfer portions T1 by the action of the respective primary transfer rollers 10. At this time, to each of the primary transfer rollers 10, a predetermined primary transfer voltage (primary transfer bias) which is a DC voltage of an opposite polarity (positive in this embodiment) to the charge polarity of the toner during the development is applied. For example, during full-color image formation, the respective color toner images formed on the four photosensitive drums 12Y, 12M, 12C, 12K are successively transferred superposedly onto the intermediary transfer member 6, so that multiple toner images for a full-color image are formed on the intermediary transfer member 6. The toner images formed on the intermediary transfer member 6 are transferred (secondary-transferred) at the secondary transfer portion T2 onto a transfer-receiving material S, sandwiched and fed by the intermediary transfer member 6 and the secondary transfer roller 11, by the action of the secondary transfer roller 11. At this time, to the secondary transfer roller 11, a predetermined secondary transfer voltage (secondary transfer bias) which is the opposite polarity to the normal charge polarity of the toner is applied.

The transfer-receiving material S such as a recording sheet or a plastic sheet is fed to the secondary transfer portion T2 by a feeding device 18. The device 18 includes a cassette (sheet feeding) portion 19, a manual sheet feeding portion 20, a registration roller pair 21 for feeding the transfer-receiving material S to the secondary transfer portion T2 at predetermined timing, and the like. The transfer-receiving material S on which the toner images are transferred is heated and pressed in a process of being nipped and fed through a fixing nip formed by a fixing roller 23 and a pressing roller 24 in a fixing device 22, and the toner images are fixed thereon. Thereafter, the transfer-receiving material S is fed by a discharging roller pair 25 and the like and is discharged onto a tray 26 provided on an upper surface of the apparatus main assembly 1 of the image forming apparatus 100. As a detecting unit, an optical sensor unit 29 is provided in a downstream side of a black image forming portion, for the final color, of the intermediary transfer member 6, and detects registration marks (toner marks) 28 which are formed with respective color toners and which are reference images for detecting color registration marks formed on the intermediary transfer member 6. On the basis of a detection result thereof, as an adjusting operation of the image forming apparatus, color registration correction such as correction of image writing start positions on the photosensitive drums 12 is carried out.

<Optical Sensor Unit 29>

Figure 2:
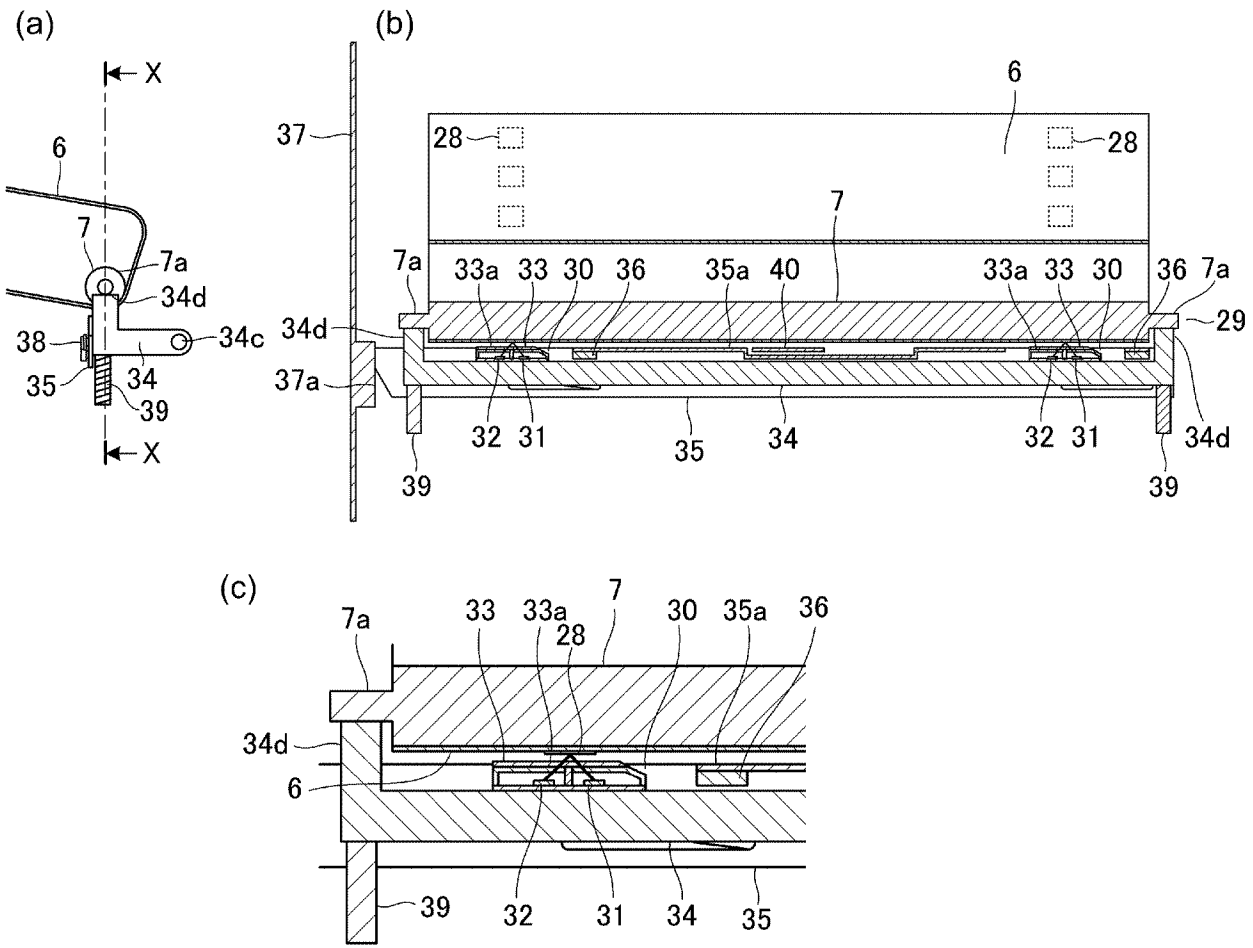
In FIG. 2, (a) to (c) are schematic views showing an optical sensor unit in the embodiment.

The optical sensor unit 29 will be described with respect to FIGS. 2 to 5. In FIG. 2, (a) is a schematic view of a general structure as seen in a direction perpendicular to a toner image feeding direction (i.e., a direction in which a rotation shaft (axis) of a rotatable member such as the driving roller 7 extends). In FIG. 2, (b) is a schematic sectional view showing the general structure of the optical sensor unit 28 as seen in an arrow X direction (X-X cross-section) indicated by a chain line shown in (a) of FIG. 2. In FIG. 2, (c) is an enlarged view of the neighborhood of an optical sensor 30 in (b) of FIG. 2.

As shown in (c) of FIG. 2, the optical sensor 30 which is a detecting portion includes an LED 31 as a light emitting portion for emitting light and a photo-transistor 32 as a light receiving portion for receiving reflected light reflected by the intermediary transfer member 6. Further, in the neighborhood of the optical sensor 30, there is a liability that the LED 31 and the photo-transistor 32 are contaminated by deposition of dust suspended in the air and of the toner scattered from the toner image on the intermediary transfer member 6 although a toner amount is slight. As a countermeasure against the contamination, the optical sensor 30 includes a cover glass 33 as a light-transmissive cover member provided so as to cover the LED 31 and the photo-transistor 32.

As shown in (b) of FIG. 2, the optical sensor 30 is disposed at two positions corresponding to widthwise end portions of the intermediary transfer member 6 so as to be associated with the registration marks 28 formed in two lines at widthwise end portions of the intermediary transfer member 6 along a belt movement direction, and is held or supported by an optical sensor supporting member 34. As shown in (a) of FIG. 2, the optical sensor supporting member 34 includes a shaft portion 34*c* extending in parallel to a driving roller shaft 7*a*. The shaft portion 34*c* of the supporting member 34 is rotatably engaged with a hole-shaped portion provided in a main assembly frame 2, so that the supporting member 34 is supported rotatably about the shaft portion 34*c*. Further, the supporting member 34 receives an urging force generated by an optical sensor supporting member spring 39, so that a contact portion 34*d* of the supporting member 34 is contacted to and urged against the driving roller shaft 7*a* of the driving roller 7. Further, the optical sensor 30 is provided so as to irradiate, with light, a region, of an outer peripheral surface of the intermediary transfer member 6, where the intermediary transfer member 6 is stretched by and wound around the driving roller 7. For example, even when a belt surface of the intermediary transfer member 6 violently moves in an in-plane direction and a shaft deviation generates in the driving roller 7, a distance between the optical sensor 30 and the driving roller 7 is kept constant, whereby the optical sensor 30 can maintain a distance thereof with the intermediary transfer member 6 (portion supported by the driving roller 7).

<Operations of Optical Sensor Supporting Member 34 and Optical Sensor Cover 35>

Figure 3:
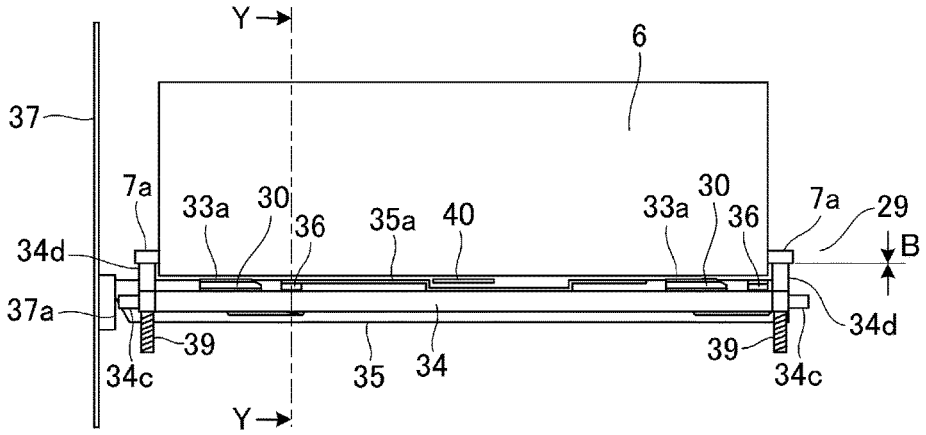
In FIG. 3, (a) and (b) are front views for illustrating an operation of the optical sensor unit in the embodiment.
Figure 3:
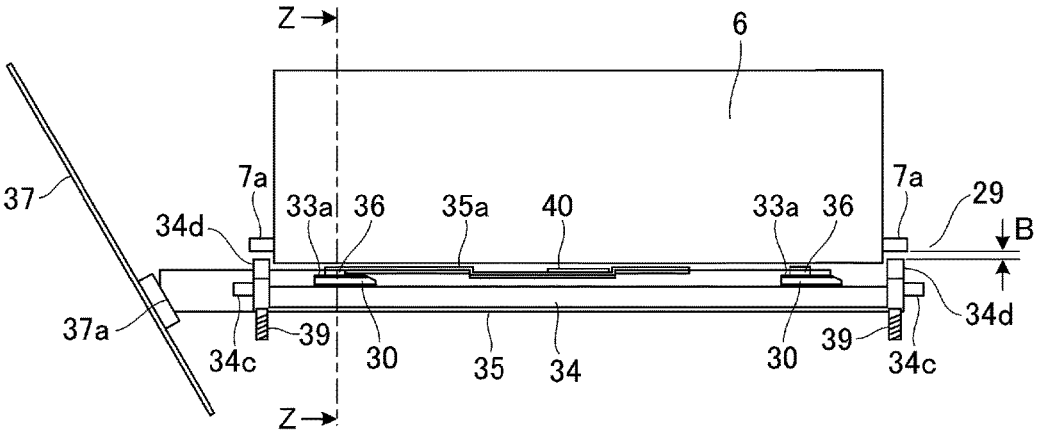
Figure 4:
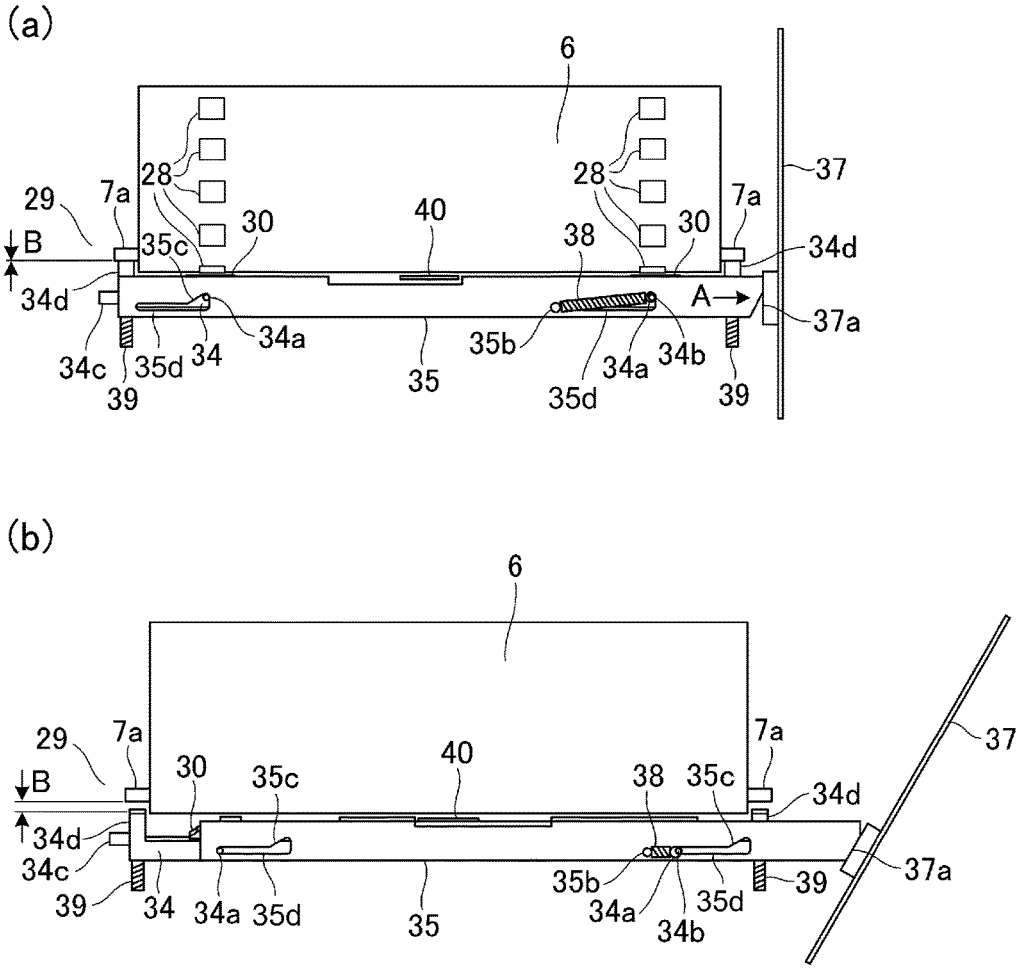
In FIG. 4, (a) and (b) are rear views for illustrating the operation of the optical sensor unit in the embodiment.
Figure 5:
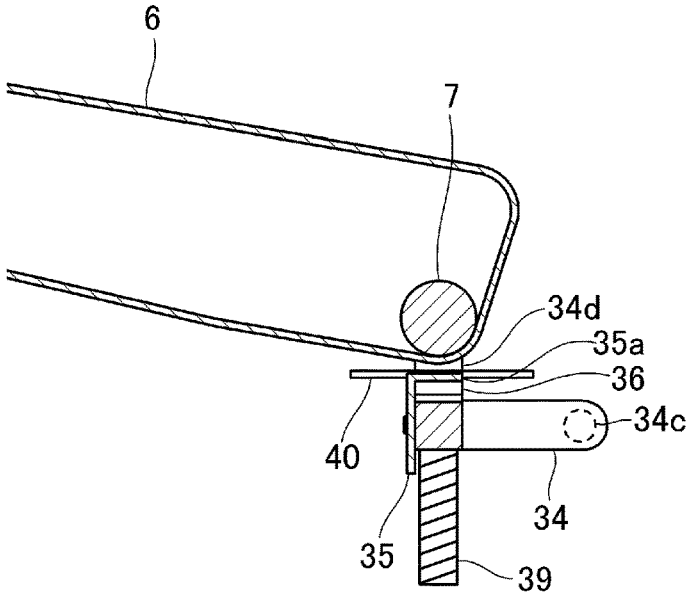
In FIG. 5, (a) and (b) are sectional views for illustrating the operation of the optical sensor unit in the embodiment.
Figure 5:
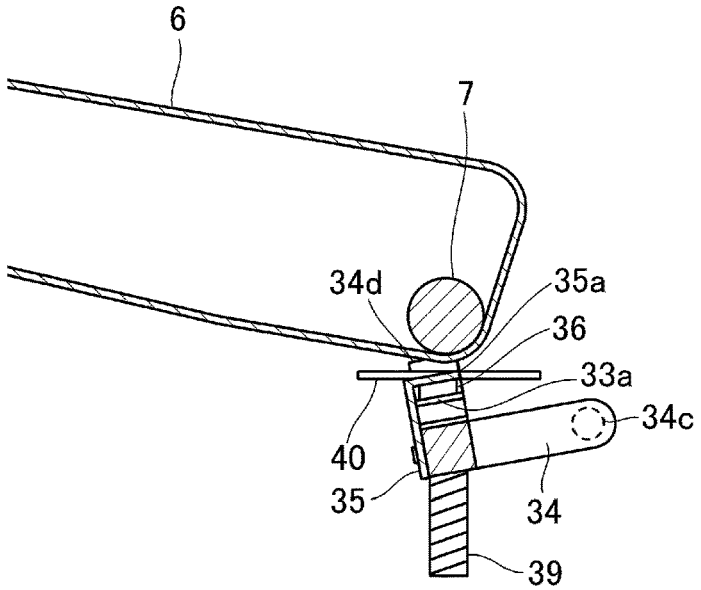

With reference to FIGS. 3 to 5, operations of the supporting member 34 an optical sensor cover 35 which is a movable member will be described. In FIG. 3, (a) and (b) are schematic views of the optical sensor unit 29 as seen in the arrow X direction shown in (a) of FIG. 2, wherein (a) shows a state in which a process cartridge exchange door 37 (openable member) is closed, and (b) shows a state in which the process cartridge exchange door 37 is open. In FIG. 4, (a) and (b) are schematic views of the optical sensor unit 29 as seen in a direction opposite to the arrow X direction shown in (a) of FIG. 2, wherein (a) shows a state in which the process cartridge exchange door 37 (openable member) is closed, and (b) shows a state in which the process cartridge exchange door 37 is open. In FIG. 5, (a) and (b) are schematic sectional views of the optical sensor unit 29 as seen in a direction perpendicular to a toner image feeding direction, in which (a) corresponds to a Y-Y cross-sectional view of (a) of FIG. 3 and shows a state when the process cartridge exchange door 37 is closed (i.e., when the supporting member 34 is in a first position), and (b) corresponds to a Z-Z cross-sectional view of (b) of FIG. 3 and shows a state when the process cartridge exchange door 37 is open (i.e., when the supporting member 34 is in a second position).

The supporting member 34 and the optical sensor cover 35 are constituted so as to be movable between two relative positions. One is a first position (arrangement) where optical detection by the optical sensor 30 can be carried out. At this time, the supporting member 34 is in a position (proximity position) where the optical sensor 30 is opposed to the intermediary transfer member 6 with a predetermined distance (first distance) suitable for the cleaning detection. That is, this position is a position such that light of the LED 31 reflected by the registration marks on the intermediary transfer member 6 can be received by the photo-transistor 32 without blocking between the optical sensor 30 and the intermediary transfer member 6 with a cleaning member 36 described later. At this time, the cleaning member 36 is in a position (retracted position) where the cleaning member 36 is retracted from an opposing space between the optical sensor 30 and the intermediary transfer member 6, and in this embodiment, the cleaning member 36 is positioned in a space of a gap between the supporting member 34 and the intermediary transfer member 6.

The other position is a second position (arrangement) where the optical sensor 30 is cleaned by the cleaning member 36, and the cleaning member 36 is positioned between the optical sensor 30 and the intermediary transfer member 30 and the intermediary transfer member 6. At this time, the supporting member 34 further spaces the optical sensor 30 from the intermediary transfer member 6 than when the supporting member 34 is in the proximity position, and thus is in a position (spaced position) where the cleaning member 36 forms a cleaning space, for cleaning the cover glass 33, between the optical sensor 30 and the intermediary transfer member 6. With movement of the supporting member 34 from the proximity position to the retracted position, the cleaning member 36 moves from the retracted position to a position (cleaning position) where the cleaning member 36 cleans the cover glass 33. The cover 35 has a substantially L-shaped cross-section as shown in FIG. 5, and supports the cleaning member 36 by a movable portion 35*a* constituted so as to be substantially parallel to a surface-to-be-cleaned 33*a* of the cover glass 33 for the optical sensor 30.

The supporting member 34 and the cover 35 are integrally locked with each other so as to be movable relative to each other. The cover 35 as a movable member moves in a widthwise direction of the intermediary transfer member 6 in interrelation with an opening/closing operation of the process cartridge exchange door 37 (hereinafter referred to as a door 37) as an openable member. The supporting member 34 rotationally moves about the shaft 34*c* in interrelation with the movement of the cover 35.

Specifically, as shown in FIG. 4, a projected portion 34*a* provided on the supporting member 34 engages with a groove 35*d* (groove portion) provided in the cover 35. Further, one of a tension spring 38 is hanged on a hook 34*b* of the optical sensor cover supporting member 34, and the other end of the tension spring 38 is hanged on a hook 35*b* of the cover 35. The cover 35 is urged in an arrow A direction in (a) of FIG. 4 by an urging force for contracting the tension spring 38.

Movement of the cover 35 by the urging force of the tension spring 38 is prevented (limited) by contact of the cover 35 with a receiving portion 37*a* of the door 37. That is, in a state in which the door 37 is closed, as shown in (a) of FIG. 4, the position of the cover 35 is limited to a position in which the above-described first position is formed, so that the optical sensor 30 can detect the registration marks 28. Further, in a state in which the door 37 is open, as shown in (b) of FIG. 4, a limiting position by the receiving portion 37*a* changes, so that the cover 35 is moved in the arrow A direction by the urging force of the tension spring 38.

The groove 35*d* has a constitution in which a groove width is changed so that a locking position of the projected portion 34*a* of the supporting member 34 with respect to a rotational movement direction changes. Specifically, in the above-described first position, a width of the groove 35*d* with respect to a direction perpendicular to the movement direction of the cover 35 is formed widely so that the contact portion 34*d* is in a state in which the contact portion 34*d* is locked or is not locked at a position where a contact state of the contact portion 34*d* with the driving roller shaft 7*a* is formed. Incidentally, the groove 35*d* may also have a constitution in which the locking position is changed by changing an extending direction of the groove (by curve or bending) while keeping a constant width.

The supporting member 34 is guided at the projected portion 34*a* by an inclined surface portion 35*c* of the groove 35*a* with the movement of the cover 35 in interrelation with the opening operation of the door 37, so that the supporting member 34 receives a force, from the cover 35, acting in the rotational direction and rotationally moves about the shaft portion 34*c* relative to the main assembly frame 2. The rotational movement of the supporting member 34 is such that the supporting member 34 is spaced from the intermediary transfer member 6 since approach of the cover 35 (the movable portion 35*a*) toward the intermediary transfer member 6 is prevented by a stopper 40 fixed to the main assembly frame 2. By this movement, a gap B is formed between the driving roller shaft 7*a* of the driving roller 7 and the contact portion 34*d*. On the other hand, also the cover 35 is provided integrally with the supporting member 34 and is rotated with the rotation of the supporting member 34, so that the cover 35 changes its position relative to the intermediary transfer member 6, but a rotation amount thereof is smaller than a rotation amount of the supporting member 34. That is, as shown by a change from (a) of FIG. 5 to (b) of FIG. 5, the cover 35 moves in the widthwise direction of the intermediary transfer member 6 while somewhat rotating about the shaft portion 34*a* in integration with the supporting member 34 while changing its position relative to the supporting member 34. In the case where the movement of the cover 35 is seen from the supporting member 34 rotationally moving from the proximity position to the retracted position, the movement of the cover 35 is relative movement such that the cover 35 moves in a direction of spacing from the supporting member 34 while moving in a direction of extension of the rotation shaft of the supporting member 34. This relative movement between the supporting member 34 and the cover 35 with the change in position from the first position to the second position is movement such that these members are spaced from each other relatively in a direction perpendicular to the surface-to-be-cleaned 33*a* of the cover glass 33. By this relative movement, in the second position, between the optical sensor 30 and the intermediary transfer member 6, a space in which the cleaning member 36 provided on the cover 35 can enter for cover glass the surface-to-be-cleaned 33*a*.

<Cleaning Mechanism Provided on Optical Sensor Cover 35>

On the surface of the cover glass 33 of the optical sensor 30, dust suspending in the air and toner scattered from the toner images on the intermediary transfer member 6 although a toner amount is slight are deposited in some cases. The deposition of the dust and the toner deteriorates a (light-)transmissive property of the cover glass 33, and induces a fluctuation (lowering) in output of the optical sensor 30 particularly at the surface-to-be-cleaned 33*a* which is an upper surface of the cover glass 33 and which is an opposing surface to the intermediary transfer member 6 since the surface-to-be-cleaned 33*a* is a detection light passing region. In order to prevent such an output fluctuation by the cleaning, the cover 35 is provided with the cleaning member 36 for cleaning the surface-to-be-cleaned 33*a* of the cover glass 33. The cleaning member 36 carries out cleaning by sliding (contact) with the surface-to-be-cleaned 33*a* of the cover glass 33 with the relative movement, between the supporting member 34 and the cover 35, from the first position to the second position. The supporting member 36 is an elastic non-woven fabric, and is in an elastically compressed state between the surface-to-be-cleaned 33*a* and the cover 35 during the sliding with the surface-to-be-cleaned 33*a*.

Figure 6:
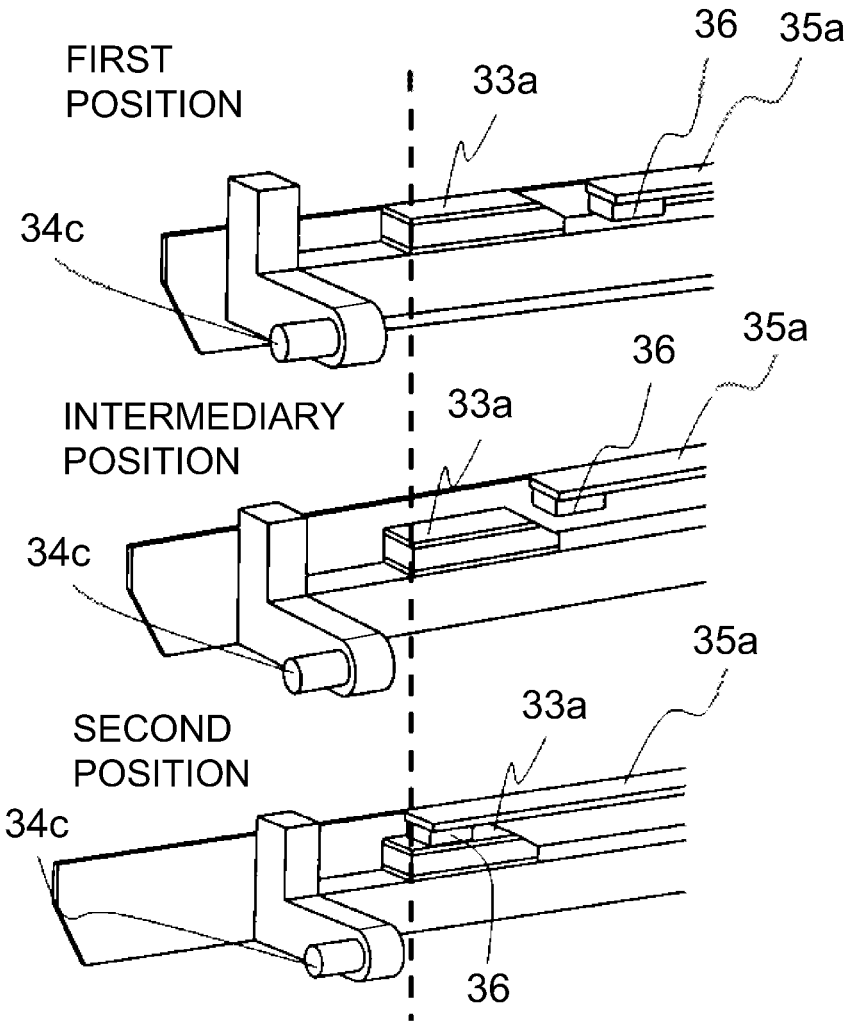
FIG. 6 is a front perspective view for illustrating the operation of the optical sensor unit in the embodiment.

FIG. 6 includes perspective views showing relationships among the surface-to-be-cleaned 33*a*, the cleaning member 36 and the movable portion 35*a* at the first position, the second position and an intermediary position between the first position and the second position. As shown in FIG. 6, in the case of the first position, the cleaning member 36 is positioned below (in the shaft portion 34*c* side) the surface-to-be-cleaned 33*a*. Then, in the case of the intermediary position, the movable portion 35*a* moves upwardly, so that the cleaning member 36 is positioned on a level with the surface-to-be-cleaned 33*a*. Then, by movement of the cleaning member 36 from the intermediary position to the second position, the cleaning member 36 cleans the surface-to-be-cleaned 33*a*.

Figure 7:
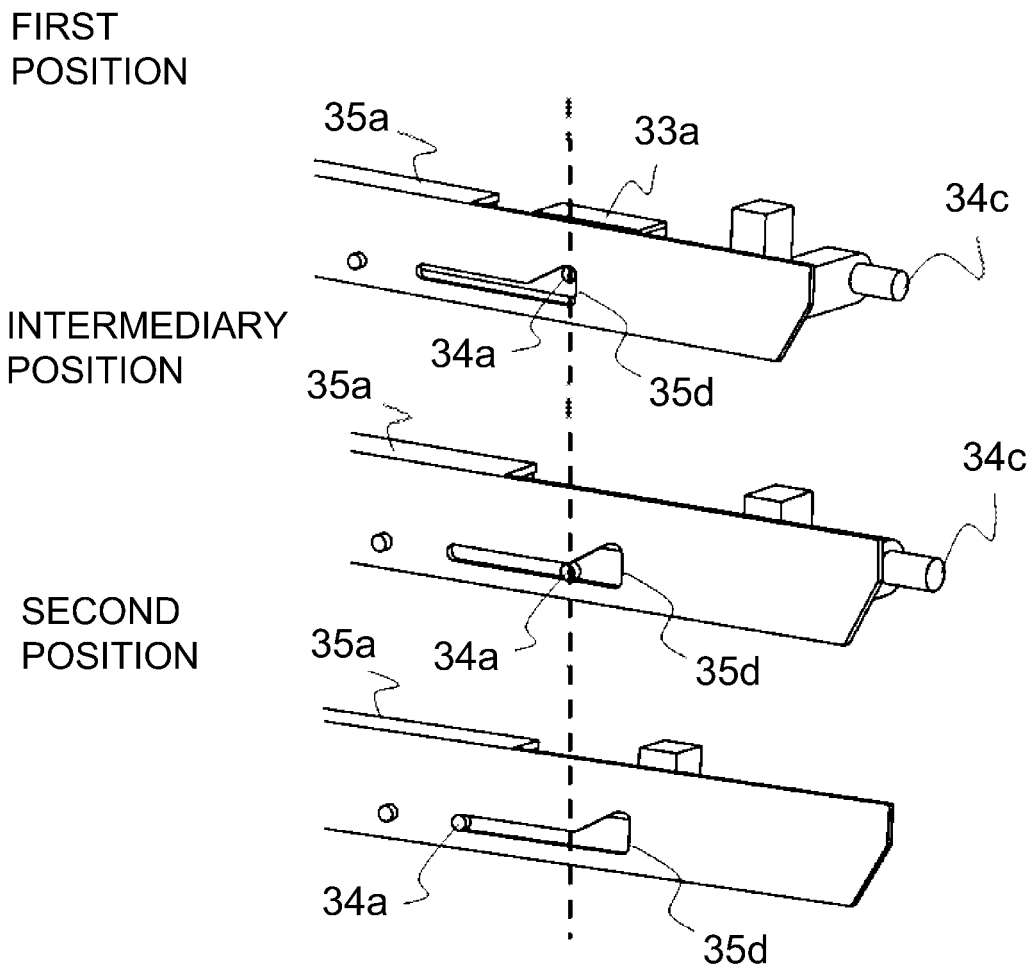
FIG. 7 is a rear perspective view for illustrating the operation of the optical sensor unit in the embodiment.

FIG. 7 includes perspective views showing relationships among the surface-to-be-cleaned 33*a*, the cleaning member 36 and the movable portion 35*a* at the first position, the second position and an intermediary position between the first position and the second position, in which the perspective views are seen from a back side of FIG. 6. The projected portion 34*a* limited by the groove 35*d* is moved by the movement of the cover 35, so that the supporting member 34 moves downwardly.

As described above, in this embodiment, a mechanism for moving the supporting member 34 and the cover 35 of the optical sensor unit 29 relative to each other is provided so that the relative position between the supporting member 34 and the cover 35 can include the first position and the second position.

In the first position, an arrangement suitable for optical detection by the optical sensor 30, specifically an arrangement in which a distance between the optical sensor 30 and the intermediary transfer member 6 can be maintained as a suitable distance in the optical detection is made. The cleaning member 36 is constituted in this arrangement so as to fall within a gap space among the intermediary transfer member 6, the optical sensor 30 and the supporting member 34 inside the apparatus main assembly 1. Specifically, a height of the sum of the height of the cleaning member 36 and the height of the movable portion 35*a* of the cover 35 is constituted so as to be shorter than a distance between the intermediary transfer member 6 and the supporting member 34 at the first position, i.e., a position where the optical detection is carried out. Further, a length of the movable portion 35*a* of the cleaning member 36 with respect to the belt widthwise direction is such that the movable portion 35*a* falls within a region between the optical sensors 30 disposed at end portions with respect to the belt widthwise direction in the opposing space between the intermediary transfer member 6 and the supporting member 34. That is, when the optical detection is carried out, i.e., when an image forming operation is performed, in the arrangement in the apparatus main assembly 1, there is no need to particularly ensure a space for the cleaning member 36 and the movable portion 35*a*.

In the second position, an arrangement in which the distance between the optical sensor 30 and the intermediary transfer member 6 is increased and the cleaning member 36 enters the gap between the optical sensor 30 and the intermediary transfer member 6 and can clean the surface-to-be-cleaned 33*a*, of the cover glass 33, which is the detection light passing region is made. Further, a movable region of the cover 35 with the change in above-described arrangement extends in a movable region space of the door 37 in an outside of the apparatus main assembly 1. That is, a part of the movable region of the movable member necessary to change the above-described arrangement is not positioned in an inside space of the apparatus main assembly 1 but is positioned outside the apparatus main assembly 1, and overlaps with a movable region of a member having the movable region outside the apparatus main assembly 1. Accordingly, a necessary space in the arrangement in the apparatus main assembly 1 is only a space necessary to ensure the rotational movement of the supporting member 34 for forming a space in which the supporting member 36 enters the gap between the optical sensor 30 and the intermediary transfer member 6. As a result, the space necessary to change the above-described arrangement can be reduced in the apparatus main assembly 1.

In this embodiment, as the movable region of the member required to be moved to the outside of the apparatus main assembly 1, the movable region of the process cartridge exchange door 37 is used, but a movable region of another member required to ensure a movable space in an outside of the apparatus main assembly 1 during installation of the image forming apparatus 100 may also be used. Or, a dead space formed by extrusion of such a movable member to the outside of the apparatus main assembly 1, e.g., a space below the door 37 is used to reduce the movable region, in the apparatus main assembly 1, necessary to change the arrangement. Incidentally, the position where the cover 35 protrudes is not limited to the specific position as described above, but from the viewpoint of the installation space of the image forming apparatus, the above-described constitution may preferably be employed.

As described above, according to this embodiment, downsizing of the image forming apparatus can be realized while maintaining detection accuracy of the optical sensor by forming a proper detection distance in the optical detection and by reducing the space necessary to change the arrangement in the apparatus main assembly. Accordingly, contamination of the optical detecting means with the toner can be prevented simply without upsizing the image forming apparatus 100 and deteriorating the accuracy of the optical sensor 30, so that it becomes possible to obtain a high-quality color image by high-accuracy color registration control and density control. Further, by the high-accuracy color registration control and density control, it becomes also possible to reduce times of the color registration control and the density control.

Incidentally, the above-described embodiment is merely an example of a specific constitution to which the present invention is applicable, and the present invention is not limited to the above-described embodiment. For example, in this embodiment, the present invention is applied to the optical sensor unit 29 which is a color registration sensor, but is also applicable to another optical portion necessary to eliminate contamination of the cover glass. Further, in this embodiment, the cover glass 33 is provided as the member-to-be-cleaned, but the present invention is also applicable to cleaning of a member constituted by a molded member formed of a light-transmissive sheet material or a resin material, and a similar effect can be obtained. Further, the cleaning member 36 is formed with the non-woven fabric but may only be required to have cleaning power, and may also be, for example, a brush member or a member, formed of an elastic material, constituting a scraper.

Further, in the above-described embodiment, the supporting member 34 is held rotatably relative to the main assembly frame 2 by engaging the shaft portion 34*a* thereof in a hole-shaped portion of the main assembly frame 2, and the contact portion 34*a* is urged against and contacted to the driving roller shaft 7*a* of the driving roller 7. However, the present invention is not limited to the constitution of the above-described embodiment when a constitution in which a distance between the intermediary transfer member 6 and the surface-to-be-cleaned 33*a* of the cover glass 33 can be changed and in which the cleaning member 36 moves between the intermediary transfer member 6 and the surface-to-be-cleaned 33*a* and cleans the surface-to-be-cleaned 33*a* is employed. For example, a similar effect can be obtained also in a constitution in which the position is determined by a slide constitution in which the supporting member 34 is operated in a sliding manner.

Further, in the above-described embodiment, the tension spring 38 is used in the operation of the cover 35, but the cover 35 may only be required the interrelated with the door 37 and therefore may also have another constitution. For example, in the case where an urging force of the tension sprig 38 such that there is a liability of generation of creep deformation of the door 37 is needed, the cover 35 and the door 37 may only be required to be in interrelation with each other by a link part (member). By providing the link member, there is no need to use the tension spring 38, so that the urging force for the door 37 can be eliminated.

Further, in the above-described embodiment, the cover 35 is provided with the cleaning member 36, but another constitution may also be employed when in the constitution, the surface-to-be-cleaned 33*a* of the cover glass 33 can be cleaned when the cleaning member 36 moves from the first position to the second position. For example, the cover 35 interrelated with the door 37 may also be not provided directly with the cleaning member 36. That is, a constitution in which the cleaning member 36 is provided on a cleaning supporting member held movably directly on the optical sensor 30 and in which the cleaning supporting member is moved between the first position and the second position by the cover 35 may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-005051 filed on Jan. 14, 2016, which is hereby incorporated by reference herein in its entirety.

What is claimed is:

1. An image forming apparatus comprising:

an image bearing member for bearing a developer image;

an optical sensor including a light emitting portion for emitting light to a surface of said image bearing member, a light receiving portion for receiving the light reflected by the surface of said image bearing member, and a cover member, having a light-transmissive property, for covering said light emitting portion or said light receiving portion;

a cleaning member for cleaning said cover member in contact with said cover member, said cleaning member being movable; and a supporting member for supporting said optical sensor, said supporting member being movable between a proximity position, where said optical sensor opposes said image bearing member with a predetermined distance, and a spaced position, where said optical sensor is spaced from said image bearing member by a distance more than the predetermined distance to form a cleaning space for permitting said cleaning member to move thereinto for cleaning of said cover member with said cleaning member between said optical sensor and said image bearing member, wherein, when said supporting member is in the proximity position, said cleaning member is in a retracted position and, in the retracted position said cleaning member (i) is retracted from an opposing space between said optical sensor and said image bearing member and (ii) is in a space of a gap between said image bearing member and said supporting member, and wherein, when said supporting member is in the spaced position, said cleaning member moves toward a cleaning position from the retracted position for cleaning said cover member with said cleaning member.

2. An image forming apparatus according to claim 1, further comprising a movable member movable together with the cleaning member, wherein said movable member moves the cleaning member relative to the cover when the support member is in the retracted position.

3. An image forming apparatus according to claim 2, further comprising an openable member for opening and closing an inside thereof, wherein said movable member moves said cleaning member from the retracted position to the cleaning position in interrelation with an opening operation of said openable member.

4. An image forming apparatus according to claim 3, wherein a part of a movable region of said movable member overlaps with a movable region of said openable member.

5. An image forming apparatus according to claim 3, further comprising an urging member for generating an urging force for urging said movable member against said openable member, wherein a position of said movable member is changed by an opening and closing operation of said openable member through a change in position where movement of said movable member by the urging force is prevented by contact of said movable member with said openable member.

6. An image forming apparatus according to claim 5, wherein said urging member is a spring mounted to said supporting member at one end thereof and mounted to said movable member at the other end thereof, wherein movable directions of said supporting member and said movable member are different from each other, and wherein said supporting member is moved from the proximity position to the spaced position by receiving a force acting in a movable direction thereof from said movable member moving so that said cleaning member is moved from the retracted position to the cleaning position by the urging force.

7. An image forming apparatus according to claim 6, wherein said supporting member is provided movably relative to a main assembly of said image forming apparatus by rotational movement thereof between the proximity position and the spaced position, and wherein said movable member moves relative to the rotational movement of said supporting member between the proximity position and the spaced position so that said movable member moves in a direction spaced from said supporting member while moving in a direction in which a rotation shaft of said supporting member extends.

8. An image forming apparatus according to claim 1, wherein said image bearing member is an intermediary transfer member onto which a toner image is transferred from a photosensitive member.

9. An image forming apparatus according to claim 1, wherein said optical sensor detects the developer image, formed on said image bearing member, as a reference image used for adjusting an operation of said image forming apparatus.

10. An image forming apparatus comprising:

an image bearing member for bearing a developer image;

an optical sensor including a light emitting portion for emitting light to a surface of said image bearing member, a light receiving portion for receiving the light reflected by the surface of said image bearing member, and a cover member, having a light-transmissive property, for covering said light emitting portion or said light receiving portion;

a cleaning member for cleaning said cover member in contact with said cover member, said cleaning member being movable;

a supporting member for supporting said optical sensor, said supporting member being movable between a proximity position, where said optical sensor opposes said image bearing member with a predetermined distance, and a spaced position, where said optical sensor is spaced from said image bearing member by a distance more than the predetermined distance to form a cleaning space for permitting said cleaning member to move thereinto for cleaning of said cover member with said cleaning member between said optical sensor and said image bearing member; and a movable member supporting said cleaning member and movable together with said cleaning member in a predetermined direction, wherein, when said supporting member is in the proximity position, said cleaning member is in a retracted position and, in the retracted position said cleaning member (i) is retracted from an opposing space between said optical sensor and said image bearing member and (ii) is in a space of a gap between said image bearing member and said supporting member, wherein, when said supporting member is in the spaced position, said cleaning member moves toward a cleaning position from the retracted position for cleaning said cover member with said cleaning member, and wherein said supporting member moves between the proximity position and the spaced position in interrelation with movement of said cleaning member between the retracted position and the cleaning position in the predetermined direction.

11. An image forming apparatus according to claim 10, wherein said movable member is provided with a groove engageable with a projected portion provided on said supporting member.

12. An image forming apparatus according to claim 10, wherein said image bearing member is an intermediary transfer member onto which a toner image is transferred from a photosensitive member.

13. An image forming apparatus according to claim 10, wherein said optical sensor detects the developer image, formed on said image bearing member, as a reference image used for adjusting an operation of said image forming apparatus.

* * * * *